US005271958A

United States Patent [19]

Szczepanski et al.

[11] Patent Number: 5,271,958

[45] Date of Patent: Dec. 21, 1993

[54] PROCESS FOR PREPARING PRINT-ON CF SHEET FROM HIGH SOLIDS AQUEOUS DISPERSION

[75] Inventors: Nadine M. Szczepanski, Jacksonville, Ill.; Noble Yoshida; Robert A. Fetters, both of Chillicothe, Ohio

[73] Assignee: The Mead Corporation, Dayton, Ohio

[21] Appl. No.: 772,102

[22] Filed: Oct. 7, 1991

Related U.S. Application Data

[63] Continuation-in-part of Ser. No. 599,589, Oct. 18, 1990, abandoned, which is a continuation-in-part of Ser. No. 212,648, Jun. 28, 1988.

[51] Int. Cl.[5] ..... B41M 3/12

[52] U.S. Cl. ..... 427/150; 427/151; 427/152

[58] Field of Search ..... 427/150–152

[56] References Cited

U.S. PATENT DOCUMENTS 4,559,242 12/1985 Mitsuo et al. ..... 427/150

4,631,204 12/1986 Mitsuo et al. ..... 427/150

*Primary Examiner*—Janyce Bell

*Attorney, Agent, or Firm*—Thompson, Hine and Flory

[57] ABSTRACT

A process for preparing a developer sheet on a forms press with little drying and a developer sheet are disclosed wherein an aqueous dispersion of a developer material containing about 50 to 80% solids is applied to the front surface of a substrate in a wet coat weight of about 0.75 to 1.5 pounds/1300 square feet; said dispersion comprising a developer material, an image intensifier, and a water miscible, non-volatile solids booster.

8 Claims, No Drawings

PROCESS FOR PREPARING PRINT-ON CF SHEET FROM HIGH SOLIDS AQUEOUS DISPERSION

CROSS-REFERENCE TO RELATED APPLICATION

This application is a continuation-in-part of U.S. application Ser. No. 07/599,589, filed Oct. 18, 1990, now abandoned which is a continuation-in-part of U.S. application Ser. No. 07/212,648 filed Jun. 28, 1988.

BACKGROUND OF THE INVENTION

The present invention relates to an improved method for preparing a mill quality, high solids, aqueous, carbonless CF coating that can be applied onto paper with very little drying. The coated paper is dimensionally stable and exhibits no, or very little, curl or cockle.

Carbonless paper is now widely used in the forms industry. A typical carbonless form is made up of one sheet, known as a CB sheet, which is the first page of the form and a second sheet, known as a CF sheet, which is the back page of the form. Where a form having more than two sheets is desired, as in the case where more than one copy is required, one or more sheets known as CFB sheets may be placed between the CF and the CB sheet. A CB sheet consists of a sheet of paper having a layer of microcapsules containing a color former coated on its back side, hence the designation CB or "coated back." A CF sheet consists of a sheet of paper carrying a layer of a developer material on its front side or "coated front" which reacts with the color former to produce a colored mark. A CFB sheet is coated on its front and back sides. The front is coated with developer and the back is coated with microcapsules. The manifold carbonless forms will usually comprise from about 2 to about 10 individual sheets and preferably from about 2 to about 4 individual sheets per form.

Generally speaking, two approaches have been taken to the manufacture of carbonless manifoldforms. In one approach the forms paper is coated at a paper mill and shipped to the forms manufacturer who prints, perforates and collates the form. In the second approach, the CF and CB coating compositions are applied to the form by the forms manufacturer on the forms press. The latter methods are herein referred to as "on press" methods as contrasted with "off press" methods where the CF and CB coatings are applied at the paper mill. One type of CF coating is a resin dissolved in an oil. The coating does not dry after application and a blurring appearance occurs in the CFB forms produced. Other coating methods employ a volatile organic solvent to dissolve the CF resin. Environmentally and economically, a water based coating is desirable.

A number of CF and CB coating compositions have been designed for application on the press. However, there are currently no aqueous print-on CF coatings of good quality available.

U.S. Pat. No. 4,186,115 describes a CB coating comprising a color precursor and a liquid radiation curable composition which cures to a frangible resin.

U.S. Pat. No. 4,091,122 discloses CF and CB coating compositions containing a color developer or color precursor and a liquid radiation curable substance.

U.S. Pat. No. 4,143,890 discloses a hot melt CB coating composition prepared by dispersing an encapsulated color precursor into a wax based composition.

U.S. Pat. Nos. 4,097,619 and 4,112,138 describe on press processes using the aforementioned hot melt and radiation curable CF and CB coating compositions.

U.S. Pat. No. 3,914,511 to Vassiliades discloses a process for spot printing aqueous-based CF and CB coating compositions using a printing roll having a raised resilient surface. According to the patent, the technique can be used to apply localized CB coating as well as CF coatings. The CF coatings are dispersions of acid clays, talc and other inorganic developers in water.

One of the drawbacks of prior on press aqueous CB and CF coating compositions is that they generally do not provide the image and/or typewriter intensity that off press coatings provide. One reason for this is that on press coating compositions are designed to set with little or no drying. This usually means that the coatings must be applied at lower coat weights than those applied at the mill which is generally in the range of about 3.3 pounds/1300 sq. in. As a consequence printing quality often suffers. In order to provide a sufficient quantity of developer material on the surface of the form to give high image density, high coat weights of these developer compositions are required. This has relegated the use of the aqueous resin dispersion to mill operations where drying capacity is available to set these high coat weights as opposed to on the press where the drying capacity is limited.

SUMMARY OF THE INVENTION

The present invention is directed to a novel method for preparing a mill quality CF developer sheet on a forms press wherein a dispersion of a developer resin and an image intensifier in water and a water miscible, non-volatile diluent is applied at high solids level and reduced coat weight to at least a portion of the front surface of a paper web. This method can be performed "on press" as well as "off press" because the high solids dispersion can be applied to the paper with little drying. The term "on press" means that the developer composition is coated on the paper while the paper is on a business forms press. The term "off press" means a coating operation not conducted on a business forms press such as a coating operation conducted in a paper mill.

In accordance with one embodiment of the present invention, a dispersion of a developer resin and an image intensifier in water and a water miscible non-volatile solids booster, the dispersion containing about 50 to 80% nonaqueous solids, is applied to paper or another equivalent substrate at a wet coat weight of about 0.75 to 1.5 pound/1300 square feet. These dispersions preferably have a viscosity of about 100 cps to 1500 cps, and preferably about 250 cps to 700 cps. The compositions are advantageous because they can be coated on or off the press with minimum drying and without solvent removal equipment and the precautions which accompany it. In most cases, the coating can be dried on the press simply using a heated roller to provide a dry coat weight of about 0.1 to 1 lbs/1300 sq. ft. and more preferably about 0.2 to 0.6 lbs./1300 sq. ft.

In accordance with still another embodiment of the invention, a developer sheet is provided wherein the developer sheet comprises a substrate having a layer of a developer material on the surface thereof, said developer material being coated from a dispersion of a developer resin and a solid image intensifier in water and a water miscible, non-volatile solids booster, said dispersion containing about 50 to 80% solids and preferably about 55 to 65% solids.

The developer coating made in accordance with this invention exhibits good capillary action and sits up on the surface of the substrate in which it is coated so that it is readily accessible for reaction with the color precursor. Both factors combine to improve density.

DETAILED DESCRIPTION OF THE INVENTION

The developer materials useful in the present invention are those conventionally employed in carbonless paper technology and are well known (see, e.g., U.S. Pat. No. 4,399,209). Illustrative examples are clay minerals such as acid clay, active clay, attapulgite, etc.; organic acids such as tannic acid, gallic acid, propyl gallate, etc.; acid polymers such as phenolic resins, e.g., phenol-formaldehyde resins, phenol acetylene condensation resins, condensates between an organic carboxylic acid having at least one hydroxyl group and formaldehyde, etc.; metal salts of aromatic carboxylic acids such as zinc salicylate, tin salicylate, zinc 2-hydroxynaphthoate, zinc 3,5 di-tert-butyl salicylate, oil soluble metal salts of phenol-formaldehyde novolak resins, zinc carbonate, etc., and mixtures thereof. Examples of such developer resins are described in U.S. Pat. Nos. 3,455,721; 3,466,184; 3,672,935; 3,732,120; 3,737,410; 4,025,490; 4,226,962 and 4,612,254.

A typical example of a useful phenolic resin is the condensation product of phenols (including substituted phenols) and formaldehyde. The resin may be further modified to include amounts of salicylic acids or substituted salicylic acids in a manner known in the art.

Another class of phenolic resin useful in the present invention is the products of oxidative coupling of substituted or unsubstituted phenols or biphenols. Oxidative coupling may be catalyzed by various catalysts but a particularly desirable catalyst is the enzyme, horseradish peroxidase. Particularly desirable developers are the resins described in commonly assigned U.S. Pat. Nos. 4,647,952 and 4,900,671 and more particularly the product of oxidative coupling of bisphenol A.

The phenolic developers used in the present invention are preferably metallated to improve their developing characteristics. They may be metallated by reaction with a salt selected from the group consisting of copper, zinc, aluminum, tin, cobalt and nickel salts. Most typically, the resins are zincated to improve development. The metal content of the resins generally is about 1 to 5% by weight but may range up to 15%.

Preferably developer materials such as phenol-formaldehyde condensation products are used. More particularly, alkylphenolic resins and, still more particularly, metallated products of alkylphenolic resins are used. The alkyl phenols are monosubstituted by an alkyl group which may contain 1 to 12 carbon atoms. Examples of alkyl phenols are ortho- or para- substituted ethylphenol, propylphenol, butylphenol, amylphenol, hexylphenol, heptylphenol, octylphenol, nonylphenol, t-butylphenol, t-octylphenol, etc.

Another useful developer material is a resin-like condensation product of a polyvalent metal salt, such as a zinc salt, and a phenol, a phenol-formaldehyde condensation product, or a phenol-salicyclic acid-formaldehyde condensation product. This developer material is available from Schenectady Chemical Co. under the designation HRJ 4250 and HRJ 4252. These products are reported to be metallated condensation products of an ortho- or para- substituted alkylphenol, a substituted salicyclic acid, and formaldehyde.

Aqueous dispersions of the developer resin may be obtained by any one of several methods. The developer material can be prepared in a conventional manner and a melt of the material can be atomized and dispersed in a solution of an emulsifying agent and water. Alternatively, a melt of the developer material can be added to a rapidly agitated aqueous medium containing a dispersant. The developer material can also be dissolved in a solvent/non-solvent system and the solvent removed. Or, a slurry of the developer resin in water can be ground in an attritor with ⅛" balls. Other predispersed developer materials such as HRJ 2969, HRJ 4002, HRJ 4250, and HRJ 4252 resins are obtained from the Schenectady Chemical Co. in the form of an aqueous dispersion. The former two resins are zincated salicylated nonylphenols.

Although the dispersion coatings of the present invention have a high solids content of about 50 to 80% solids and preferably about 55 to 65% solids, high concentrations of the developer resin are unnecessary. Image intensifiers such as clays, calcium carbonate, calcium sulfate, silicas, talc, and the like have a positive impact on image intensity. While it is not entirely clear, it is believed that the enhanced image intensity is achieved through increasing hold out and increasing the surface area of the developer resin. When the resin coats the image intensifier particles, it acquires a high surface area which makes it much more efficient in generating color. Other image intensifiers which may be employed in the present invention include titanium dioxide, alumina trihydrates, satin white, barium sulfate, silicates.

In order to reduce the drying requirements of the coating, up to about 70% or more of the water forming the aqueous dispersion is replaced with a water miscible, non-volatile solids booster. Useful water miscible non-volatile solids boosters may be solid or liquid materials. Examples of solid boosters are non-reducing sugars such as methyl glucosides, dimethyl urea, dimethyl hydantoin formaldehyde resin, and polyoxyethylene polyols such as carbowax 4000. Liquid boosters useful in the present invention include polyhydric alcohols such as ethylene glycol, 1,2- and 1,3-propylene glycol, 1,3-butylene glycol, 1,4-butylene glycol, diethylene glycol, glycerol, sorbitol, erythritol, polyethylene and polypropylene glycols, 1,2- and 1,5-pentamethylene glycol, 1,6-hexanediol, 2,5-hexanediol, ethylene glycol monomethyl and monoethyl ethers, propylene glycol monoethyl ether acetate; dioxane; tetrahydrofuran; tetrahydropyran; glycol ethers such as cellusolves; diethylene glycol alkylene ethers such as carbitols and Dowanols (available from Dow Chemical Co.). The aqueous-water miscible, non-volatile solids booster system preferably contains water and non-volatile solid booster in a ratio of water to booster of about 1:1 to 4:1.

Particularly desirable dispersants for dispersing the developer resins of this invention in water are polyvinyl alcohol (PVA) and polyvinylpyrrolidone (PVP). Other useful dispersants include gum arabic, starch, polyethylene glycol, polyacrylates, pectin, carboxymethylcellulose (CMC), hydroxyethylcellulose and the like. The dispersant is typically used in an amount of about 5% (dry weight) or about 0.2 to 1 part per 10 parts of the developer resin. The dispersant, when present, can also help bind the resin particles to the developer sheet.

Other additives may be employed in the practice of this invention, such as binders, defoamers, surfactants, stabilizers, etc. in amounts which are effective to produce the desired result. These additives are typically present in minor amounts of about 0.01 to 10%.

The typical components and the amounts of such components which make up the composition of the aqueous-developer dispersions useful in the present invention are set forth in the following table:

| Component | General Range | Preferred Range |
|---|---|---|
| Developer | 5% to 55% | 10% to 30% |
| Image Intensifier | 20% to 60% | 30% to 50% |
| Solids Booster | 10% to 70% | 20% to 40% |
| Water | 20% to 50% | 35% to 50% |
| Binder or Dispersant | 1% to 10% | 3% to 7% |

Preferably the particle size of the dispersion ranges from about 0.1 to 10 microns and more typically averages about 1 to 3 microns.

The solids content and the viscosity of the dispersion as well as the coat weight are controlled to minimize the need for drying and to hold the resin out on the surface of the paper where it is most accessible to the color former. Thus, higher image/typewriter intensities are achieved.

Aqueous dispersions of developer resins on the press can be used in conjunction with known methods of forms manufacture. In this regard, aqueous dispersions of developer resins can be used in the processes described in U.S. Pat. No. 4,097,619 to Davis et al. and U.S. Pat. No. 4,112,138 to Davis et al. The process of the present invention can be a process in which a plurality of continuous webs are advanced in a cooperating relationship, printed, coated with CF and CB compositions, collated, and finished.

The resin dispersions can be applied to any of the substrates commonly used in the manufacture of carbonless papers and forms. Included in the preferred materials are paper and plastic films although other substrates can be substituted. The continuous webs can be supplied in any of a variety of shapes, sizes and configurations. The preferred and most common shape is a roll form.

In accordance with one embodiment of the present invention, a manifold carbonless form having one surface coated with a developer material is formed by providing a web having a front and a back surface; marking the front surface; and applying a dispersion containing about 50 to 80% nonaqueous solids of a developer material and a solid image intensifier in water, and a water miscible, non-volatile solids booster to at least a portion of the front surface of the web at a wet coat weight of about 0.75 to 1.5 pounds/1300 square feet.

The individual substrates are subjected to a printing or marking step prior to or after the coating step. Because the resin dispersions are somewhat opaque, they are preferably applied to the substrate prior to printing. For purposes of this application the term "printing" shall be understood to be generic to printing, writing, lining or any other marking of a continuous web whether the marking is visible or not. In the preferred process of this invention the topmost surface of each individual web of the plurality of continuous webs is printed with a printing ink to provide the printed information and blanks usually found in a business form. However, it is sometimes the case that only one surface, normally the topmost surface, of the topmost continuous web will be so marked. The actual content of the printing and the number of webs which are marked are dependent on the particular form being manufactured and may be conveniently adjusted during the manufacturing operation.

In the preferred embodiment of this invention the printing step is performed by the application of a marking fluid, preferably a printing ink, by a suitable printing apparatus to one or more surfaces of the continuous webs. The preferred printing method is offset although any of the other well known printing methods are equally applicable. The actual printing method depends on the printer capabilities of the particular manufacturer. The inks which can be used in this printing step are any of the inks commonly used in the printing industry. The ink must only be selected from a group or type which are compatible with the coating process and composition.

For the production of manifold carbonless forms according to the process of this invention it is necessary that at least one coating composition be applied to at least one surface of at least one web. In the preferred embodiment of this invention each web of the plurality of webs except the topmost web, will have a CF coating containing a color developer on the topmost surface and a CB coating containing an encapsulated color precursor on the bottom most surface with the exception of the bottom most web which will contain a CF coating but no CB coating.

A particular advantage of the process of this invention is that it permits the use of spot coating. Spot coating refers to the fact that less than 100% of the surface area of the individual sheet is coated. For instance, the area of the paper normally associated with the margin on either side of the printed side portion need not be coated. This, of course, represents a significant cost advantage in the savings of material. The use of spot printing can vary from simply omitting coating of the margin portion of the paper to the making of a form wherein only a single line is actually coated. At the same time, forms such as computer printouts can be made wherein only every other line is coated. Thus, it can be seen that from about 10% to about 95% of the surface area of the paper need not be coated. In most instances, it would be most convenient to simply not print the marginal areas of the paper which would save from about 10% to about 30% of the total material cost.

The process for producing developer sheets in accordance with the present invention can be effectively employed in the production of a self-contained carbonless form by printing a microencapsulated coating composition containing a color precursor onto the coated CF sheet. Alternatively, the coating process of the present invention can be used to coat a developer material on top of the CB coating to provide a self contained carbonless form. Corresponding U.S. patent application Ser. No. 574,996, filed Aug. 30, 1990, commonly assigned to the Mead Corporation, describes a method for making a self-contained carbonless form which comprises the step of coating or printing a microcapsule composition having a high concentration of rupturable microcapsules, binder and anti-curl additives onto a dry developer coated sheet, wherein the microcapsules contain a color precursor which react with the developer upon rupture of the microcapsules to form an image.

The present invention can be used in a discontinuous process wherein individual substrates are coated and printed and then collated or a continuous process wherein a plurality of continuous webs in spaced relation are marked, coated and collated.

In accordance with one embodiment of the present invention, a manifold carbonless form having two or more surfaces coated with chromogentic material is continuously formed according to the steps of:

(a) providing a plurality of continuous webs, each of which has a front and back surface;

(b) advancing each web in a cooperating relationship with one another;

(c) applying a dispersion containing about 50 to 80% nonaqueous solids of a developer resin and a solid image intensifier in water and a water miscible, non-volatile solids booster to at least a portion of the front surface of at least one web at a wet coat weight of about 0.75 to 1.5 pounds/1300 square feet;

(d) setting the first coating;

(e) printing a pattern on at least one surface of at least one web;

(f) applying a coating of a microencapsulated color precursor to at least a portion of the back surface of at least one web;

(g) setting the second coating; and (h) collating and registering the plurality of continuous webs.

The invention is illustrated in more detail by the following non-limiting examples showing the preparation of the dispersions.

EXAMPLES 1

A ground resin slurry was prepared by grinding 144.75 g of a phenolic resin blended with the zinc salt of 3,5-di(alphamethylbenzyl) salicylic acid with 1.0 g of Aerosol OT-75 and 2.50 g of Aerosol OT-3030 (surfactants from American Cyanamid Co.), 0.75 g Colloid 681-F (defoamer from Colloids, Inc.), 30 g of a 10% aqueous solution of PVA-205 (binder and colloid stabilizer from Air Products & Chemicals, Inc.) and 105.54 g of water.

Ten g of the above slurry was dispersed in 19.0 g of water along with 7.9 g of Sta-Meg 104 (methyl glucoside from A. E. Staley), 48.6 g of Hydrocarb 60 (calcium carbonate from Omya, Inc.), 0.1 g of SWS-213 (silicone defoamer from Wacker Silicones Corp.), and 7.0 g of Gen-Flo (binder from Diversitech General). The dispersion contained 65% nonaqueous solids overall and had a viscosity of 1300 cps.

The coating was applied to 13.5 pounds raw stock at a wet coating weight of 0.75 pounds/sq. ft. on a press using an offset gravure coating station. This press operated at a speed of about 500 fpm. The resulting CF sheet had a dry coat weight of approximately 0.6 lb./1300 square feet The coating was smooth with very little curl. Image intensity was comparable to mill produced CF sheet.

EXAMPLE 2

A dispersion was prepared from a mixture of 50 g of HRJ-2969 (a proprietary zincated salicylated nonylphenol developer resin manufactured by Schenectady Chemicals, Inc.), 14.5 g of methyl glucoside, 15 g of water, 20g calcium carbonate, 0.lg SWS-213 and 0.5g of polyvinylpyrrolidone. The coating was applied to a substrate as in Example 1 and the results were similar.

EXAMPLE 3

A developer coating composition was prepared from a mixture of 1170 g of water, 75 g of Dispex N-40 (a dispersant from Allied Colloids, Suffolk, Va.) 3950 g of Exsilon 87 slurry @62% (a structured clay from Engelhard, Edison, N.J.) 869 g of Ansilex (a structured clay from Engelhard, Edison, NJ) 2227 g of a 20% Pencote (a starch from Penick and Ford, Cedar Rapids, Iowa) 2292 g of methyl glucoside, 3175 g of HRJ-2969, 1012 g of Genflo 5100 (a latex binder from Diversitech General) 75 g of Dispex N-40 and 180 g of SWS-213. Materials are listed in order of addition. If problems occur due to starch spoilage, starch can be replaced with polyvinylpyrrolidone.

Having described the invention in detail and by reference to the preferred embodiments thereof, numerous modifications and variations are possible without departing from the scope of the following claims.

What is claimed is:

1. A process for producing a color developer sheet having one surface coated with a developer material comprising providing a web having a front and a back surface, and applying a dispersion of a color developer material and an image intensifier in water and a water miscible, non-volatile solids booster to at least a portion of said front surface, wherein said water miscible, non-volatile solids booster is selected from the group consisting of methyl glucoside, dimethyl urea, dimethyl hydantoin formaldehyde resin, polyoxyethylene polyols, glycol ethers, dioxane, tetrahydrofuran and tetrahydropyran; said dispersion containing nonaqueous solids in an amount of about 50 to 80% and being applied to said surface in a wet coat weight of about 0.75 to 1.5 pounds/1300 square feet.

2. The process of claim 1 wherein said dispersion contains nonaqueous solids in an amount of about 55 to 65%.

3. The process of claim 1 wherein said aqueous dispersion comprises about 5 to 55% of said color developer material, about 20 to 60% of said image intensifier, about 10 to 70% of said water miscible, non-volatile solids booster, and about 20 to 50% water and has a viscosity of about 100 to 1500 cps.

4. The process of claim 3 wherein said color developer material is a phenolic resin.

5. The process of claim 4 wherein said image intensifier is selected from the group consisting of calcium carbonate, calcium sulfate, clay, silica, talc, titanium dioxide, alumina trihydrate, silicate, barium sulfate and satin white.

6. The process of claim 5 wherein said image intensifier is a clay.

7. The process of claim 6 wherein said water miscible, non-volatile solids booster is methyl glucoside.

8. The process of claim 7 wherein said process is performed on a forms press.

* * * * *